US007380765B2

(12) United States Patent
Shiff

(10) Patent No.: US 7,380,765 B2
(45) Date of Patent: Jun. 3, 2008

(54) ADJUSTABLE EASEL FOR SUPPORTING A WORKPIECE

(76) Inventor: Harold H. Shiff, 665 Briarridge Rd., Southlake, TX (US) 76092

( * ) Notice: Subject to any disclaimer, the term of this patent is extended or adjusted under 35 U.S.C. 154(b) by 270 days.

(21) Appl. No.: 11/205,614

(22) Filed: Aug. 16, 2005

(65) Prior Publication Data

US 2007/0040089 A1 Feb. 22, 2007

(51) Int. Cl.
*A47B 97/04* (2006.01)

(52) U.S. Cl. ..... 248/448; 248/124.1; 248/286.1; 248/451; 248/460

(58) Field of Classification Search ..... 248/441.1, 248/447–449, 458, 460, 462–464, 476, 488, 248/122.1, 124.1, 125.1, 125.9, 451–453, 248/278.1, 279.1, 286.1; 269/152, 155; 38/102.1, 38/102.7

See application file for complete search history.

(56) References Cited

U.S. PATENT DOCUMENTS

| | | | | | |
|---|---|---|---|---|---|
| 167,127 | A * | 8/1875 | Sandbach | 269/203 |
| 490,519 | A * | 1/1893 | Wayland | 269/145 |
| 1,782,118 | A * | 11/1930 | Cahall | 248/449 |
| 2,144,825 | A * | 1/1939 | Allison | 66/125 R |
| 3,926,398 | A * | 12/1975 | Vincent | 248/448 |
| 3,958,786 | A * | 5/1976 | Mann | 248/176.3 |
| 4,260,124 | A * | 4/1981 | Heilman | 248/449 |
| 5,074,513 | A | 12/1991 | Preslet et al. | |
| 5,242,145 | A * | 9/1993 | Linnell | 248/449 |
| 6,390,433 | B1 | 5/2002 | Kasa-Djukic | |
| 6,669,535 | B1 * | 12/2003 | Welty | 451/36 |
| 6,698,705 | B2 | 3/2004 | Toghanian | |
| 6,712,328 | B1 | 3/2004 | Morton | |
| 6,889,952 | B2 | 5/2005 | Cook et al. | |

OTHER PUBLICATIONS

Art Supply Warehouse Catalog, pp. 308-327, Catalog 23E, 2005.
Works in Progress Pamphlet, Best Artist's Products, 2003.

* cited by examiner

*Primary Examiner*—Korie H. Chan
(74) *Attorney, Agent, or Firm*—Jordan M. Meschkow; Lowell W. Gresham; Charlene R. Jacobsen

(57) ABSTRACT

An easel (20) includes a base (24), a support (28) extending upwardly from the base (24), and first and second arms (38, 40) rotatably attached to the support (28) via a pivot assembly (48). Brackets (54) are positioned on the first and second arms (38, 40) and are slidably moveable relative to a longitudinal axis (58) of the first and second arms (38, 40). The brackets (54) selectively abut edges (68) at each of four corners (70) of a workpiece (22) to retain the workpiece (22). The pivot assembly (48) functions to concurrently rotate the first and second arms (38, 40) and, consequently, the workpiece (22) relative to the support (28).

13 Claims, 7 Drawing Sheets

ADJUSTABLE EASEL FOR SUPPORTING A WORKPIECE

TECHNICAL FIELD OF THE INVENTION

The present invention relates to the field of graphic and fine arts. More specifically, the present invention relates to an adjustable easel for supporting a workpiece in a variety of positions.

BACKGROUND OF THE INVENTION

An easel can provide stable support and display of an artist's workpiece, such as a canvas, panel, or the like, during formation of his or her artwork. Typically, an artist's workpiece is fixed in one position on the easel, and the artist moves himself or herself relative to the position of the workpiece in order to work on all parts of it. Unfortunately, this can cause an artist to place himself or herself in an awkward posture to work on more distant regions on the fixed position workpiece. This awkward posture can be uncomfortable for the artist, and even impossible for an artist with limited mobility.

In addition, this awkward posture can hamper the artist's artistic style. One of the essential elements to artistic style is the manner in which the pencil stroke, brush stroke, or palette knife stroke is guided across the workpiece. An artist typically has a particular direction and a particular uniqueness in terms of his or her stroking that defines the style of that artist's work. When the workpiece is in a fixed position on a conventional easel, the artist may not be able to guide his or her tools in a manner conducive to the artist's desired style.

Accordingly, some artists are compelled to reposition their workpieces in order to appropriately guide their tools across the workpiece. Such an artist is faced with the task of removing the workpiece from the easel to reposition it. Manual repositioning of an artwork can be both time consuming and frustrating for the artist. Moreover, manual repositioning of the artwork still may not place it in the best position for accommodating the artist's particular stroke. More critically, in the process of handling the workpiece to reposition it on a conventional easel, an artwork can be damaged by dropping, scratching, or in some way adversely affecting the workpiece. Obviously, any resulting damage to the artwork is a highly undesirable situation for the artist.

Some artists stretch their own canvasses. In order to do so, they stretch a canvas over a stretcher, a wooden frame, and tack or staple the edge of the canvas to the stretcher. It can be difficult to hold the wooden stretcher square while applying the canvas to the stretcher. Consequently, a painting formed on a canvas attached to an out of square stretcher can be difficult or impossible to appropriately fit into a frame once the painting is completed by the artist.

SUMMARY OF THE INVENTION

Accordingly, it is an advantage of the present invention that an adjustable easel is provided for supporting a workpiece.

It is another advantage of the present invention that an adjustable easel is provided that is capable of moving in a variety of positions to accommodate an artist's preferred working posture and stroke style.

Another advantage of the present invention is that an adjustable easel is provided that can serve as a tool for stretching a canvas.

The above and other advantages of the present invention are carried out in one form by an easel for supporting a workpiece. The easel includes a base, a support extending upwardly from the base, and first and second arms rotatably attached to the support. Brackets on the first and second arms are moveable relative to a longitudinal axis of the first and second arms. The brackets are configured for selective abutment with edges of the workpiece to retain the workpiece.

BRIEF DESCRIPTION OF THE DRAWINGS

A more complete understanding of the present invention may be derived by referring to the detailed description and claims when considered in connection with the FIGS, wherein like reference numbers refer to similar items throughout the FIGS, and:

DETAILED DESCRIPTION OF THE PREFERRED EMBODIMENTS

Figure 1:
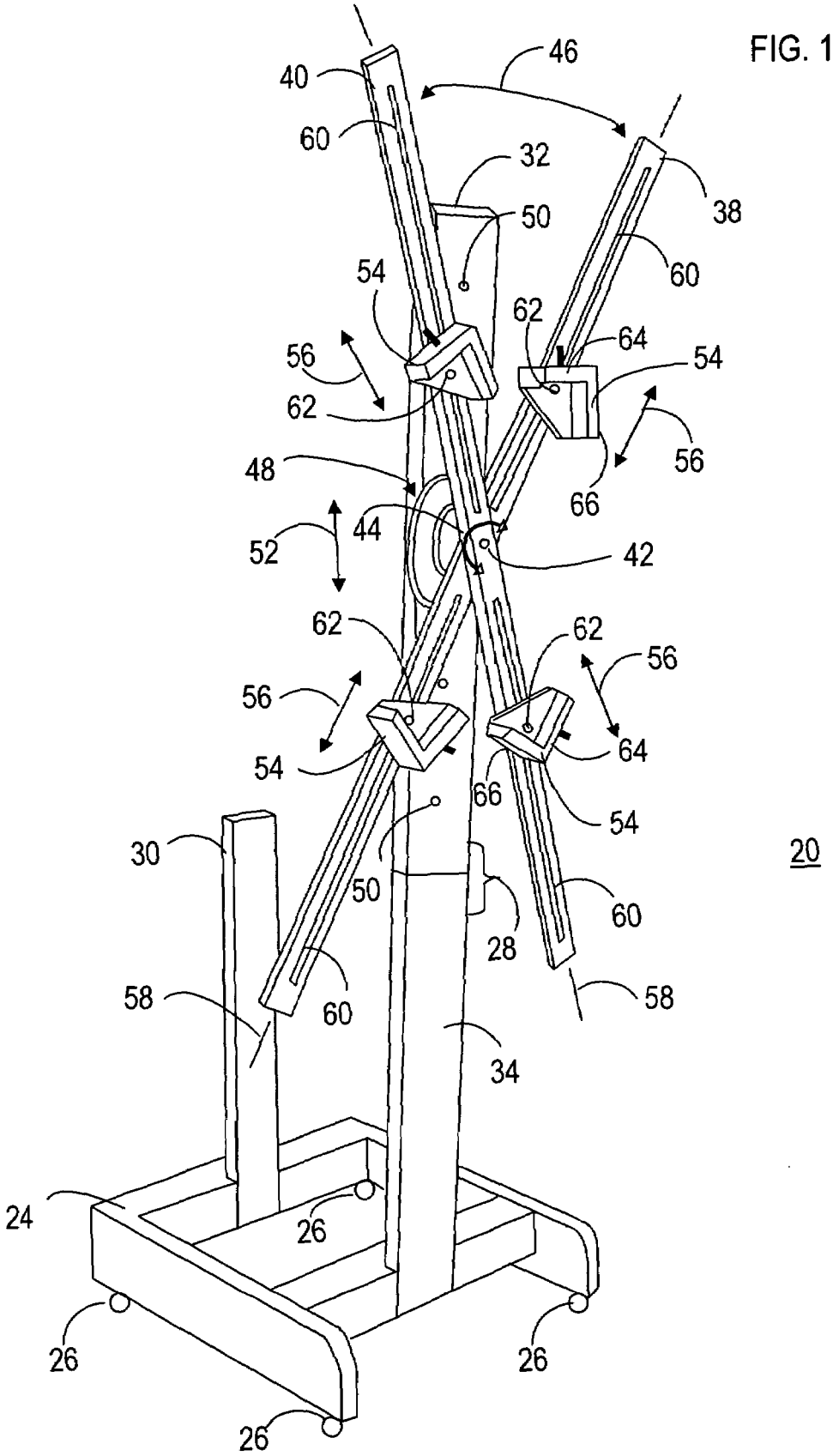
FIG. 1 shows a front perspective view of an adjustable easel in accordance with a preferred embodiment of the present invention.
Figure 2:
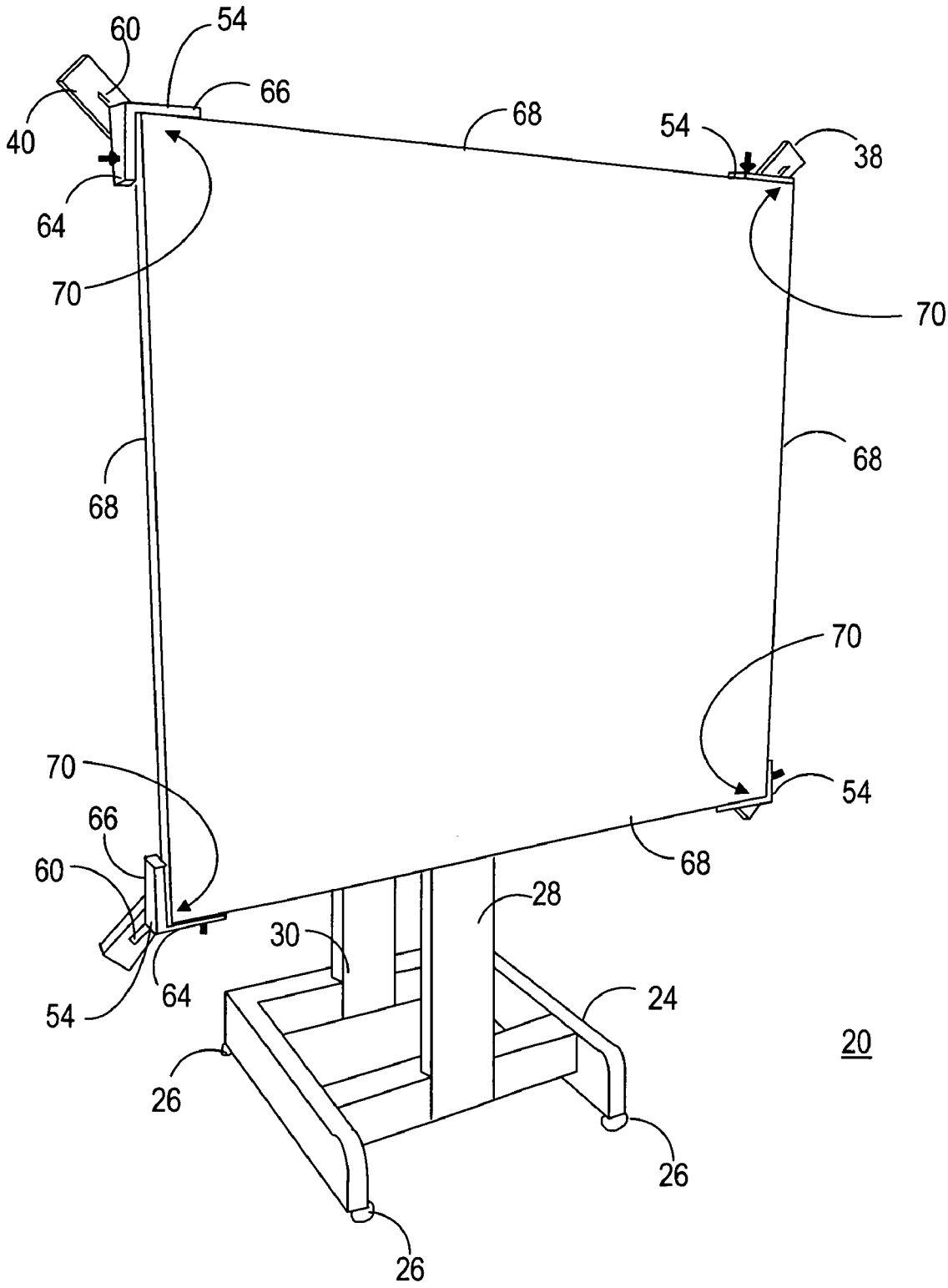
FIG. 2 shows a front perspective view of the easel of FIG. 1 supporting a workpiece.

Referring to FIGS. 1-2, FIG. 1 shows a front perspective view of an adjustable easel 20 in accordance with a preferred embodiment of the present invention, and FIG. 2 shows a front perspective view of easel 20 supporting a workpiece 22. Easel 20 is capable of supporting workpiece 22 in a variety of positions during its formation to accommodate an artist's preferred working posture and stroke style. Easel 20 is especially suitable for supporting a relatively stiff workpiece 22, such as a canvas attached to a stretcher (i.e., generally, a wooden support frame), a panel, and so forth. However, easel 20 may alternatively be adapted for supporting relatively stiff display items or artworks for presentation.

Easel 20 includes a base 24 which may include castors 26 to facilitate moving easel 20 about. A first support 28 and a second support 30 extend from base 24. First support 28 includes both a first support section 32 and a second support section 34 coupled at a hinge element 36 (visible in FIG. 3). First support section 32 can thus be tilted relative to second support section 34, as discussed below in connection with FIGS. 3 and 4.

A first arm 38 and a second arm 40 are rotatably attached to first support section 32 of first support 28. More particularly, first and second arms 38 and 40 can be rotated concurrently about a pivot axis 42, as indicated by an arrow 44, to adjust a position of workpiece 22 via a pivot assembly 48. In addition, first arm 38 and second arm 40 are capable of pivoting independent from one another, as indicated by another arrow 46, about pivot axis 42, discussed below in connection with FIGS. 6-8.

In addition, first and second arms 38 and 40, respectively, are selectively lockable via pivot assembly 48 into one of a plurality of apertures 50 at predetermined vertical positions spaced along first support section 32 of first support 28. This adjustment allows first and second arms 38 and 40 to be adjusted in a vertical direction, as indicated by an arrow 52, to accommodate seated artists as well as varying heights of standing artists.

Brackets 54 are positioned on each of first and second arms 38 and 40 and are slidably moveable, as represented by arrows 56, relative to a longitudinal axis 58 of each of first and second arms 38 and 40. More specifically, each of first and second arms 38 and 40 includes a pair of slots 60 disposed therein and oriented along longitudinal axis 58. Each of brackets 54 includes a pin member 62 slidably disposed in one of slots 60. Pin member 62 is lockable to retain its corresponding one of brackets 54 stationary relative to the one of slots 60 in which it is disposed.

In a preferred embodiment, each of brackets 54 includes a first bracket portion 64 and a second bracket portion 66, with second bracket portion 66 being arranged approximately perpendicular to first bracket portion 64. As such, first and second bracket portions 64 and 66 abut edges 68 at a corner 70 of workpiece 22. Easel 20 includes four brackets 54 for abutment at each corner 70 of workpiece 22 for secure retention of workpiece 22.

The tilt adjustment of first support section 32 relative to second support section 34 of first support 28, the concurrent rotation of first and second arms 38 and 40, respectively, about pivot axis 42, and the vertical adjustment of first and second arms 38 and 40 along first support section 32 of first support 28 allows workpiece 22 to be placed in a variety of positions for the artist's comfort and convenience.

Moreover, the capability of first and second arms 38 and 40 to pivot independent from one another about pivot axis 42 and the slidable adjustment of four brackets 54 in slots 60 of first and second arms 38 and 40 enable the secure retention of a variety of sizes of workpiece 22. Indeed, the size of workpiece 22 is simply limited by the length of first and second arms 38 and 40, respectively, the lengths of their corresponding slots 60, and may alternatively be adapted for custom configurations. In an exemplary embodiment, easel 20 can accommodate sizes of workpiece 22 from eight inches by ten inches up to forty-eight inches by forty-eight inches.

Additionally, the pivoting relationship of first and second arms about pivot axis 42 and the four corner attachment points of brackets 54 onto workpiece 22 ensure that workpiece 22 is centered at pivot axis 42, and ensure that workpiece 22 remains squared when workpiece 22 is a canvas being attached to a stretcher. As such, for those artists that stretch their own canvasses, easel 20 can be used as a tool to hold the typically wooden stretcher square while applying the canvas to the stretcher.

Figure 3:
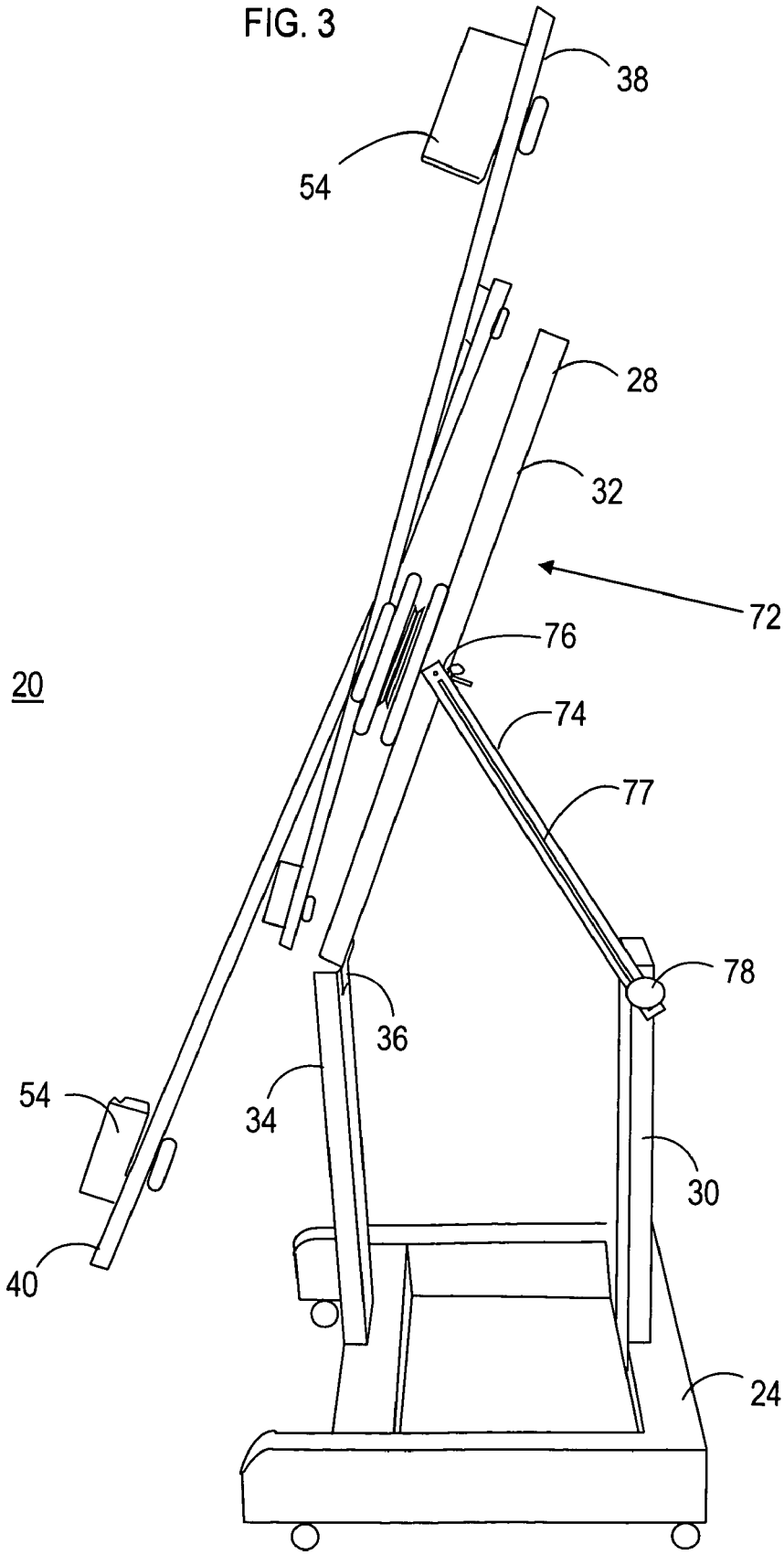
FIG. 3 shows a side view of the adjustable easel with a support for the workpiece oriented in a tilted position.

FIG. 3 shows a side view of easel 20 with first support section 32 of first support 28 for workpiece 22 (FIG. 2) oriented in a tilted position 72 relative to second support section 34. Easel 20 further includes a guide member 74 having a first end 76 pivotally coupled to first support section 32. In addition, guide member 74 is slidably connected to second support 30. As shown, guide member 74 includes a lengthwise oriented slot 77. A screw member (not visible) having a knob 78 attached thereto, is directed through slot 77 and is threaded into second support 30.

In order to tilt first support section 32 relative second support section 34, knob 78 is loosened so that first support section 32 can be tilted at hinge element 36. Knob 78 is subsequently tightened to secure the attached screw member into second support 30 and retain first support section 32 stationary relative to second support 30. Thus, first support section 32 is adjustable from a first position, such as a vertical position, to a second position, such as tilted position 72. Adjustment of first support section 32 likewise causes first and second arms 38 and 40, respectively, to tilt at a desired angle.

Figure 4:
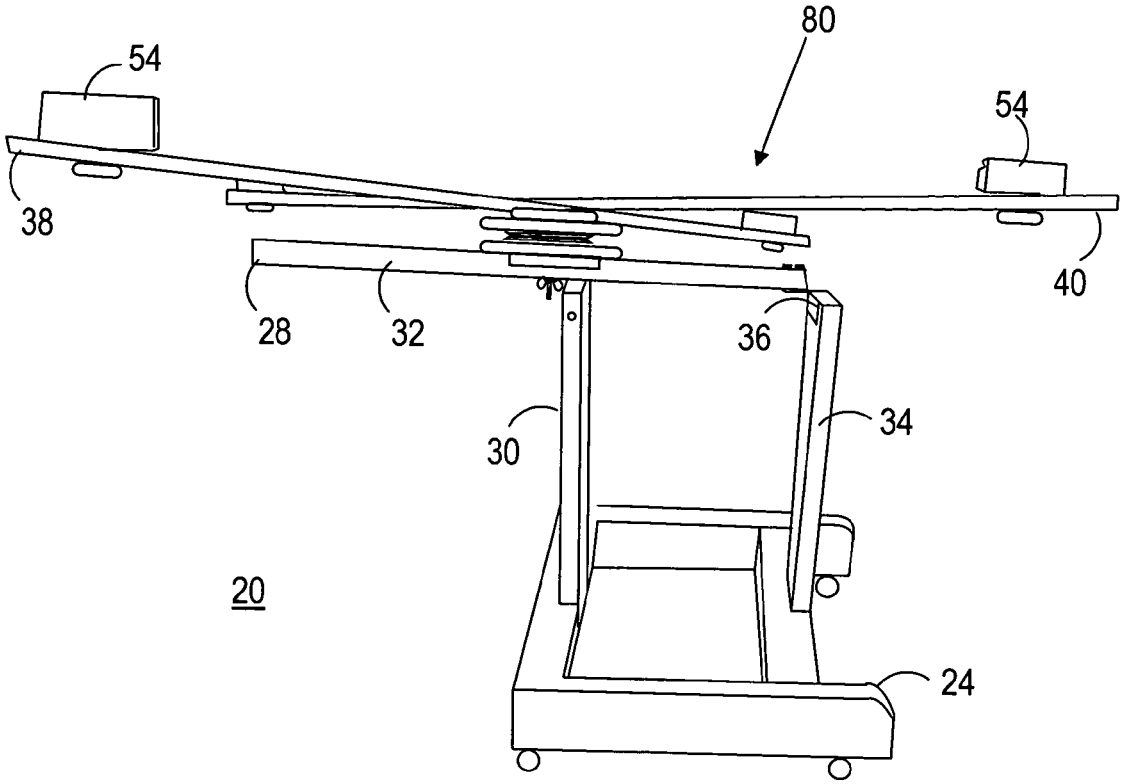
FIG. 4 shows a side view of the adjustable easel with the support for the workpiece oriented in a horizontal position.

FIG. 4 shows a side view of easel 20 with first support section 32 of first support 28 for workpiece 22 (FIG. 2) oriented in a horizontal position 80 relative to second support section 34. As shown, first support section 32 can be tilted to horizontal position 80 and supported by second support 30 so that first and second arms 38 and 40, respectively, are generally horizontal. In such a manner, workpiece 22 (FIG. 2) retained on first and second arms 38 and 40 can be oriented horizontally for watercolor artists, for artists who wish to sit down while working, or for wheelchair bound artists.

Figure 5:
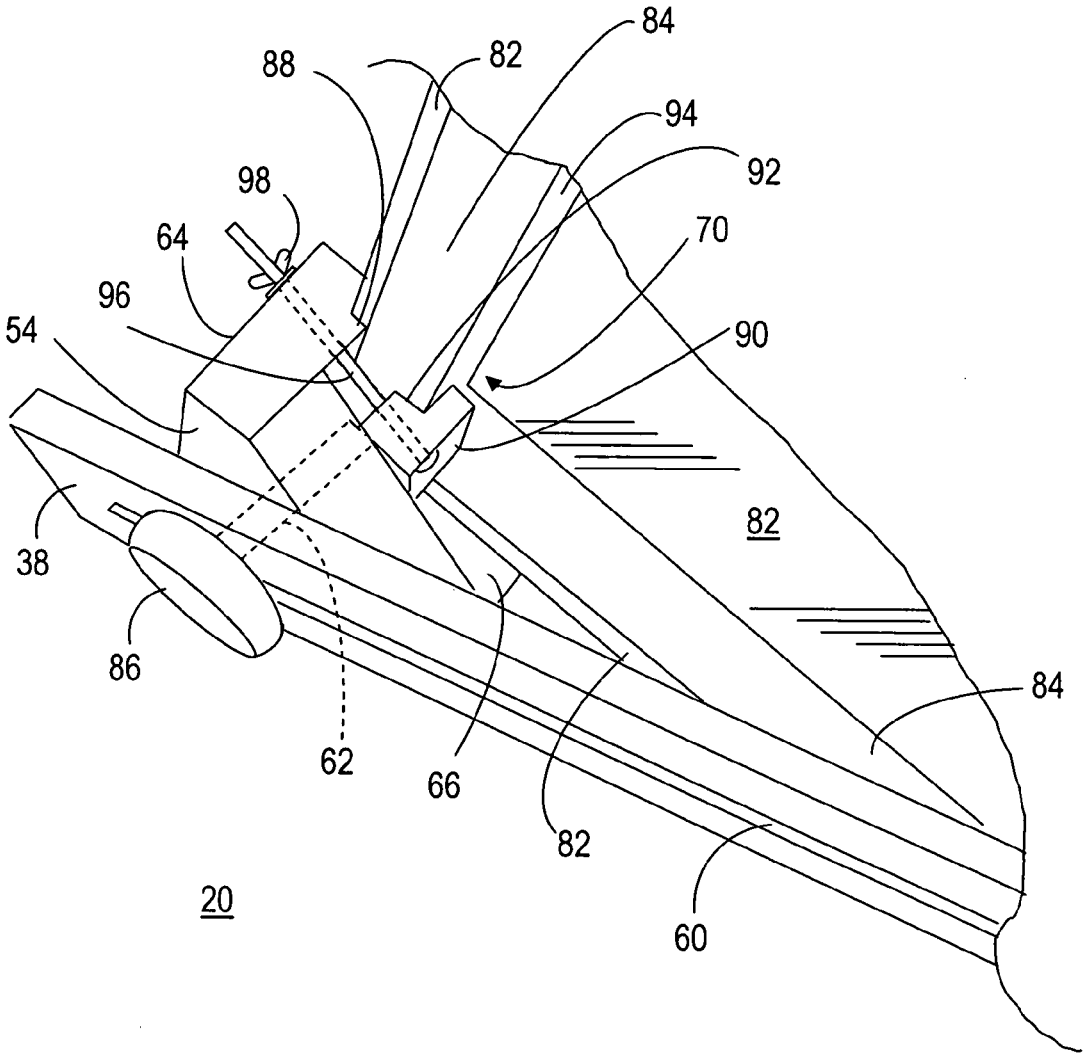
FIG. 5 shows a perspective view of a portion of the easel with one of a number of brackets configured to retain the workpiece.

FIG. 5 shows a perspective view of a portion of easel 20 with one of brackets 54 configured to retain workpiece 22. The following discussion is directed toward a singular one of brackets 54. However, it should be understood that the following discussion applies equally to all brackets 54 included on easel 20. In this exemplary situation, a back side of workpiece 22 is visible. Workpiece 22 encompasses a canvas 82 attached to a stretcher 84. As shown, canvas 82 overlays a front side of stretcher 84 and wraps around to attach to a rear side of stretcher 84.

Bracket 54 is slid along slot 60 of first arm 38 until an appropriate distance from pivot axis 42 (FIG. 1) is attained. A knob 86, coupled to pin member 62, is tightened to lock bracket 54 stationary relative to slot 60 of first arm 38. Corner 70 of workpiece 22 is seated in a shelf portion 88 formed on inner surfaces of first and second bracket portions 64 and 66, respectively.

Bracket 54 further includes a clamp element 90 having a shelf 92 in which an inner surface 94 of stretcher 84 is thus seated. A threaded rod 96 extends through clamp element 90 and first bracket portion 64 of bracket 54. Clamp element 90 is pulled into abutment with inner surface 94 of stretcher 84 by tightening a nut 98, with a washer underneath it, coupled to threaded rod 96 and located on an outer surface of bracket 54. Nut 98 may be a conventional wing nut having wing-like projections for thumb and forefinger leverage in turning. A washer may be positioned underneath nut 98 to increase the hold of nut 98 and to widen the bearing surface. As nut 98 is tightened, clamp element 90 is pulled into contact against inner surface 94 so that stretcher 84 is non-destructively secured between clamp element 90 and first bracket portion 64 of bracket 54.

Brackets 54 may be utilized in an alternative manner to retain workpiece 22 without utilizing clamp element 90. In particular, outer surfaces of first and second bracket portions 64 and 66, respectively, can alternatively abut inner surface 94 of stretcher 84. By utilizing this approach, brackets 54 are positioned on the back side of canvas 82 so that edges 68 of canvas 82 at corners 70 will not be obscured by brackets 54 when the artist is working on canvas 82. Optional L-brackets may be attached to stretcher 84 that are subsequently attached to brackets 54 to retain workpiece 22 securely to brackets 54. It should be understood that the particular clamp elements 90 and manner of retaining workpiece 22 onto easel 20 are provided for illustrative purposes. Those skilled in the art will recognize that alternative means may be employed for non-destructively retaining securing workpiece 22 to brackets 54.

Figure 6:
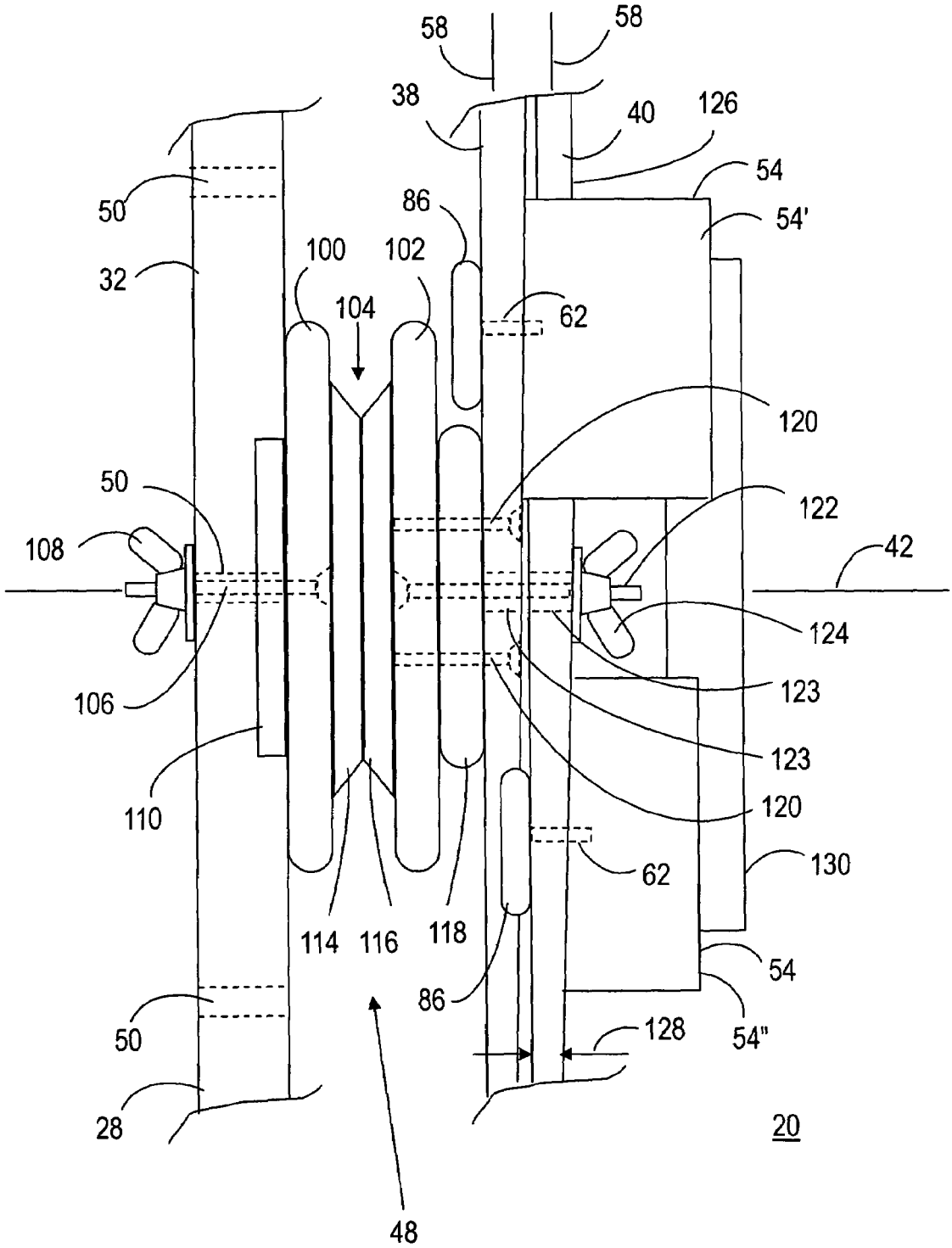
FIG. 6 shows a side view of a portion of the easel including a pivot assembly.

FIG. 6 shows a side view of a portion of easel 20 including pivot assembly 48. As discussed briefly above, pivot assembly 48 provides the capability of locking first and second arms 38 and 40, respectively, into one of a plurality of predetermined vertical positions. In addition, pivot assembly 48 provides the capability of allowing first and second arms 38 and 40 to pivot about pivot axis 42 independent from one another, and pivot assembly 48 provides the capability of allowing first and second arms 38 and 40 to pivot concurrently about pivot axis 42. Pivot assembly 48 includes a first plate 100 and a second plate 102 mounted on first plate 100. A bearing assembly 104 interposed between first and second plates 100 and 102, respectively, rotatably couples second plate 102 to first plate 100.

In order to adjust pivot assembly 48 relative to a length of first support 28, a threaded rod 106 is directed through first plate 100 and through a selected one of apertures 50 in first support section 32. A nut, in the form of a hand tightened wing nut 108 with an underlying washer, is then fastened to threaded rod 106 to engage first plate 100, and consequently first and second arms 38 and 40, with first support section 32 of first support 28. A stop 110 is coupled to first plate 100 and abuts first support section 32 to prevent pivoting movement of first plate 100 relative to section 32.

Bearing assembly 104 includes a first bearing section 114 coupled to first plate 100 and a second bearing section 116 coupled to second plate 102. Second bearing section 116 rotates relative to first bearing section 114 about pivot axis 42. Rotation of second bearing section 116 causes the attached second plate 102 to rotate, yielding rotation of first and second arms 38 and 40, respectively. Bearing assembly 104 may be a conventional ball thrust bearing system typically used for low-speed applications and low radial loads.

A spacer plate 118 and first arm 38 are fastened to second plate 102 in stacked relation with bolts 120. A threaded rod 122 is directed through second plate 102, spacer plate 118, and aligned apertures 123 located at approximate mid-points along longitudinal axes 58 of each of first and second arms 38 and 40, respectively. A fastener, such as a wing nut 124 with an underlying washer, can be attached to threaded rod 122 at an outer surface 126 of second arm 40. Wing nut 124 holds second arm 40 together with the subassembly formed of the second plate 102, spacer plate 118, and first arm 38 at slight to moderate tension, while still allowing first and second arms 38 and 40, respectively, to independently pivot when a workpiece, such as workpiece 22 (FIG. 2) or a workpiece 130 is not retained on easel 20. Thus, first and second arms 38 and 40 can be separated in a scissor-like motion to accommodate varying sizes of workpieces.

Once a workpiece, such as workpiece 22 or the illustrated workpiece 130, is mounted to brackets 54 and is centered at pivot axis 42, first and second arms 38 and 40 are prevented from pivoting independently but remain able to concurrently rotate at bearing assembly 104 about pivot axis 42 to adjust the position of workpiece 22. Thus, as second plate 102 rotates, spacer plate 118, first arm 38, and second arm 40 will also rotate.

Wing nut 124 is presented herein for simplicity of illustration. Those skilled in the art will recognize that alternative fasteners may be employed to hold second arm 40 together with the subassembly formed of the second plate 102, spacer plate 118, and first arm 38 at slight to moderate tension, while still allowing first and second arms 38 and 40, respectively, to independently pivot. By way of example, a non-adjustable rivet set to a fixed tension may be employed in place of wing nut 124.

FIG. 6 further illustrates the use of easel 20 for supporting a very small configuration workpiece 130. As shown, brackets 54 are slid in slots 60 (FIG. 1) very close to pivot axis 42. Spacer plate 118 is smaller in diameter than second plate 102 so that knobs 86 of brackets 54 can fit between second plate 102 and first arm 38.

It should be further noted that brackets 54 include first brackets 54' (of which only one is visible) moveably coupled to first arm 38 and second brackets 54" (of which only one is visible) moveably coupled to second arm 40. First brackets 54' are thicker than second brackets 54" by an amount corresponding to a thickness 128 of second arm 40. The additional thickness of first brackets 54' causes workpiece 130 to be oriented approximately parallel with first support section 32 of first support 28.

Figure 7:
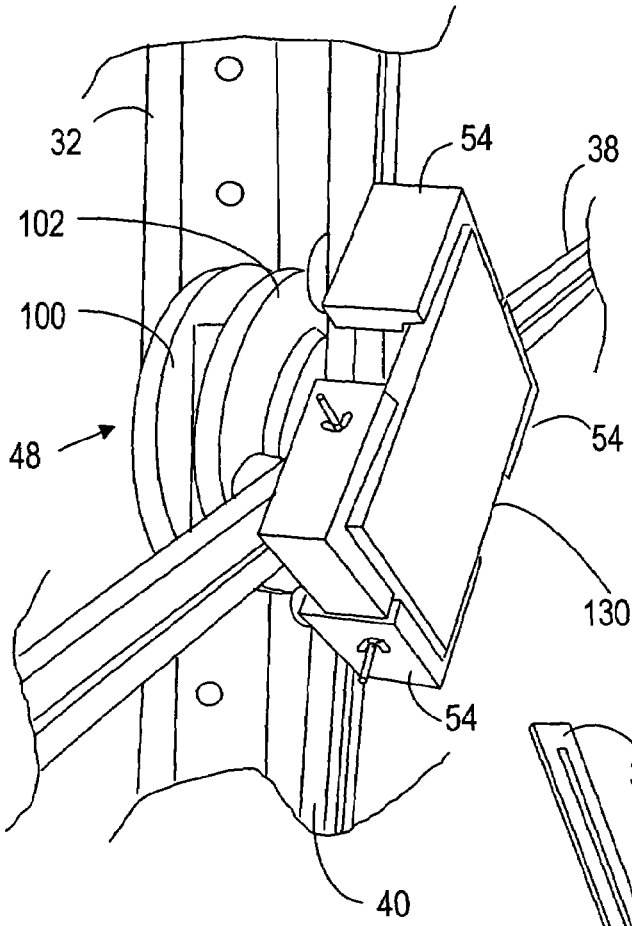
FIG. 7 shows a perspective view of a portion of the easel retaining a workpiece in a pivoted position.
Figure 8:
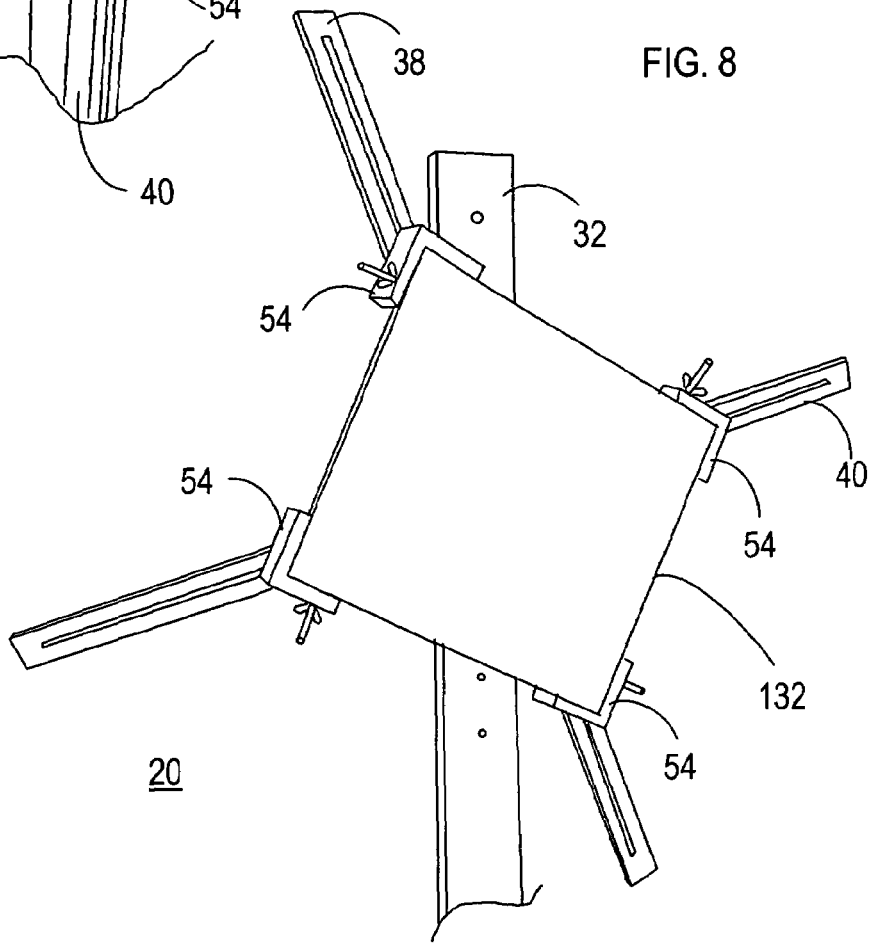
FIG. 8 shows a front perspective view of a portion of the easel retaining another workpiece.

Referring now to FIGS. 7 and 8, FIG. 7 shows a perspective view of a portion of the easel retaining workpiece 130 in a pivoted position, and FIG. 8 shows a front perspective view of a portion of the easel retaining another workpiece 132. FIGS. 7-8 are provided to further illustrate the ease and versatility with which easel 20 can accommodate a wide variety of sizes of workpieces, such as workpiece 22 (FIG. 2), the small profile of workpiece 130, and a mid-size workpiece 132.

FIGS. 7 and 8 further illustrate respective workpieces 130 and 132 having been pivoted to accommodate an artist's preferred working posture and stroke style. The artist need only apply light pressure to one of first and second arms 38 and 40 to cause them to concurrently rotate. In addition, the workpiece, regardless of size, is centered at pivot axis 42 (FIG. 1) due to the pivoting relationship of first and second arms 38 and 40 at their mid-points about pivot axis 42 and due to the retention of the workpiece by brackets 54. Consequently, the workpiece is balanced so that when it is rotated to another position, it remains in that position, instead of gravitating out of the desired position.

However, first and second arms 38 and 40 may optionally be prevented from any possible rotation by simply applying a clamp (not shown) or brake structure (not shown) between first and second plates 100 and 102, respectively. Such an optional clamp or brake structure will prevent rotation of second plate 102 relative to first plate 100, thereby preventing the rotation of first and second arms 38 and 40.

In summary, the present invention teaches of an easel that securely supports a workpiece. The easel is capable of moving in a variety of positions, by raising or lowering the pivot assembly, by tilting the support structure, and by rotation at the pivot assembly to affect rotation of the workpiece about an axis perpendicular to the support structure to accommodate an artist's preferred working posture and stroke style. In addition, brackets securely retain a canvas attached to a stretcher so that the canvas and stretcher remain square as the artwork is being formed.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An easel for supporting a workpiece comprising:

a base;

a first support extending upwardly from said base, said first support including a hinge element for adjusting said first support between a first position and a second position;

first and second arms rotatably attached to said first support, said second arm overlying said first arm at a pivot point of said first and second arms, said second arm pivoting independent from said first arm;

a second support extending upwardly from said base;

a guide member having a first end pivotally coupled to said first support, said guide member being slidably connected to said second support and selectively locked into position to adjust a tilt angle of said first and second arms; and brackets on said first and second arms, said brackets being moveable relative to a longitudinal axis of said first and second arms, and each of said brackets being configured for selective abutment with edges of said workpiece at a corner of said workpiece to retain said workpiece.

2. An easel for supporting a workpiece comprising:

a base;

a support extending upwardly from said base;

a first plate engaged with said support;

a second plate mounted on said first plate and rotatable relative to said first plate about an axis oriented perpendicular to a length of said support;

first and second arms rotatably attached to said support, said first and second arms being in communication with said second plate so that rotation of said second plate yields rotation of said first and second arms relative to said support, said second arm overlying said first arm at a pivot point of said first and second arms, said second arm pivoting independent from said first arm; and brackets on said first and second arms, said brackets being moveable relative to a longitudinal axis of said first and second arms, and each of said brackets being configured for selective abutment with edges of said workpiece at a corner of said workpiece to retain said workpiece.

3. An easel as claimed in claim 2 further comprising a bearing assembly rotatably coupling said second plate to said first plate.

4. An easel as claimed in claim 2 further comprising a rod member extending through each of said first and second arms and through said second plate, said rod member being lockable to prevent pivotal movement of said second arm relative to said first arm.

5. An easel as claimed in claim 4 wherein said each of said first and second arms includes an aperture positioned at an approximate mid-point along said longitudinal axis, and said rod member is directed through said aperture of said each of said first and second arms.

6. An easel for supporting a workpiece comprising:

a base;

a support extending upwardly from said base;

first and second arms rotatably attached to said support, said first and second arms being selectively lockable in a plurality of predetermined vertical positions spaced along said support, said second arm overlying said first arm at a pivot point of said first and second arms, said second arm pivoting independent from said first arm; and brackets on said first and second arms, said brackets being moveable relative to a longitudinal axis of said first and second arms, and each of said brackets being configured for selective abutment with edges of said workpiece at a corner of said workpiece to retain said workpiece.

7. An easel for supporting a workpiece comprising:

a base;

a support extending upwardly from said base;

first and second arms rotatably attached to said support, said second arm overlying said first arm at a pivot point of said first and second arms, said second arm pivoting independent from said first arm; and brackets on said first and second arms, said brackets being moveable relative to a longitudinal axis of said first and second arms, and each of said brackets being configured for selective abutment with edges of said workpiece at a corner of said workpiece to retain said workpiece, each of said brackets including a first frame portion and a second frame portion, said second frame portion being coupled to said first frame portion and arranged approximately perpendicular to said first frame portion such that said first and second frame portions abut said edges at said corner of said workpiece, said easel including four of said brackets for abutment at each said corner of four corners of said workpiece.

8. An easel for supporting a workpiece comprising:

a base;

a support extending upwardly from said base;

first and second arms rotatably attached to said support, said second arm overlying said first arm at a pivot point of said first and second arms, said second arm pivoting independent from said first arm; and brackets on said first and second arms, said brackets being moveable relative to a longitudinal axis of said first and second arms, and each of said brackets being configured for selective abutment with edges of said workpiece at a corner of said workpiece to retain said workpiece, said each of said brackets including clamp element adapted to non-destructively contact a portion of said edges of said workpiece, and said brackets including first brackets moveably coupled to said first arm and second brackets moveably coupled to said second arm, said first brackets being thicker than said second brackets by an amount corresponding to a thickness of said second arm.

9. An easel attachable to a support for supporting a workpiece comprising:

a first plate configured to engage with said support;

a second plate mounted on said first plate and rotatable relative to said first plate about an axis oriented perpendicular to a plane of said first and second plates;

first and second arms in communication with said second plate so that rotation of said second plate yields rotation of said first and second arms relative to said first plate, said second arm overlying said first arm at a pivot point of said first and second arms, said second arm pivoting independent from said first arm; and brackets on said first and second arms, said brackets being moveable relative to a longitudinal axis of said first and second arms, and each of said brackets being configured for selective abutment with edges of said workpiece at a corner of said workpiece to retain said workpiece.

10. An easel as claimed in claim 9 further comprising a rod member extending through each of said first and second arms and through said second plate, said rod member being selectively lockable to prevent pivotal movement of said second arm relative to said first arm.

11. An easel attachable to a support for supporting a workpiece comprising:

first and second arms configured to rotatably attach to said support, said second arm overlying said first arm at a pivot point of said first and second arms, said second arm pivoting independent from said first arm, each of said first and second arms having slots disposed therein, said slots being oriented along a longitudinal axis of said each of said first and second arms; and brackets configured to retain said workpiece, each of said brackets having a pin member slidably disposed in one of said slots such that said each of said brackets is moveable relative to said longitudinal axis, said pin member being lockable to retain said each of said brackets stationary relative to said one of said slots, and said each of said brackets including:

a first frame portion; and a second frame portion coupled to said first frame portion and arranged approximately perpendicular to said first frame portion such that said first and second frame portions abut edges of said workpiece at a corner of said workpiece.

12. An easel as claimed in claim 11 wherein said easel includes four of said brackets for abutment at each said corner of four corners of said workpiece.

13. An easel as claimed in claim 11 wherein said each of said brackets comprises a clamp element adapted to non-destructively contact a portion of said edges of said workpiece.

* * * * *